US010106362B2

(12) United States Patent
Herzog

(10) Patent No.: US 10,106,362 B2
(45) Date of Patent: Oct. 23, 2018

(54) METHOD AND DEVICE FOR DEPOSITING A FLEXIBLE MATERIAL WEB

(71) Applicant: CU4innovation GmbH, Widnau (CH)

(72) Inventor: Guido Herzog, Rheineck (CH)

(73) Assignee: CU4INNOVATION GMBH, St. Margrethen (CH)

( * ) Notice: Subject to any disclaimer, the term of this patent is extended or adjusted under 35 U.S.C. 154(b) by 574 days.

(21) Appl. No.: 14/646,589

(22) PCT Filed: Nov. 20, 2013

(86) PCT No.: PCT/EP2013/003494
§ 371 (c)(1),
(2) Date: May 21, 2015

(87) PCT Pub. No.: WO2014/079562
PCT Pub. Date: May 30, 2014

(65) Prior Publication Data

US 2015/0344259 A1 Dec. 3, 2015

(30) Foreign Application Priority Data

Nov. 22, 2012 (DE) ..... 10 2012 022 751

(51) Int. Cl.
*B65H 45/10* (2006.01)
*B65H 45/101* (2006.01)
*B65H 45/107* (2006.01)

(52) U.S. Cl.
CPC ..... *B65H 45/101* (2013.01); *B65H 45/107* (2013.01)

(58) Field of Classification Search
CPC ..... B65H 45/101; B65G 45/107
(Continued)

(56) References Cited

U.S. PATENT DOCUMENTS 2,016,539 A 10/1935 Brenn
3,858,476 A * 1/1975 DeLigt ..... B65H 45/20 493/357
5,087,140 A 2/1992 Keeton et al.

FOREIGN PATENT DOCUMENTS

CA 2288018 A1 * 10/1998 ..... B65H 45/101
DE 22 27 994 1/1974
(Continued)

OTHER PUBLICATIONS

International Search Report and Written Opinion for PCT/EP2013/003494 dated Mar. 5, 2014.

*Primary Examiner* — Patrick H Mackey
(74) *Attorney, Agent, or Firm* — Alston & Bird LLP

(57) ABSTRACT

A method and a device are specified for depositing a flexible material web, wherein the material web (2) is supplied by means of a supply means and deposited in a zigzag shape at a depositing location (2) by means of a laying means, wherein the material web (2) after exiting from the supply means is contacted by at least two engagement elements (5, 6), which can be moved at least in opposite laying directions (A, B), of the laying means and is guided to the depositing location (2). The engagement elements (5, 6) change their position during the contact with the material web (1) between an engagement position (E) and a release position (F), the quality of the deposited material web remaining largely unaffected, because each engagement element (5, 6) has a contact section (7, 8), which can be brought into a contact position (K) in the engagement position (E) and into an idle position (L) in the release position (F), wherein the movement direction (C, D) of the contact section (7, 8) is oriented at a downward angle to the laying direction (A, B).

32 Claims, 8 Drawing Sheets

(58) Field of Classification Search
USPC ..... 270/39.05
See application file for complete search history.

(56) References Cited

FOREIGN PATENT DOCUMENTS

| | | | | |
|---|---|---|---|---|
| DE | 2227994 | A1 * | 1/1974 | ..... B65B 25/00 |
| DE | 26 34 300 | A1 | 2/1977 | |
| DE | 102 03 115 | | 7/2003 | |
| DE | 10 2005 013 161 | | 9/2006 | |
| EP | 0 583 826 | | 2/1994 | |
| JP | S58 144053 | | 8/1983 | |
| WO | WO-2006099838 | A1 * | 9/2006 | ..... B65H 45/101 |

* cited by examiner

METHOD AND DEVICE FOR DEPOSITING A FLEXIBLE MATERIAL WEB

CROSS-REFERENCE TO RELATED APPLICATIONS

This application is U.S National Phase under 35 U.S.C § 371 of International Application PCT/EP2013/003494, filed Nov. 20, 2013, which claims priority to German Application No. 10 2012 022 751.5, filed Nov. 22, 2012, each of which is incorporated herein in its entirety by reference.

The present invention relates to a method for depositing a flexible material web, the material web being supplied by means of a supply means and deposited by means of a laying means in a zigzag shape at a depositing location, the material web being contacted after exiting from the supply means by at least two engagement elements of the laying means which can be moved at least in opposite laying directions and being guided to the depositing location, and the engagement elements changing their position during the contact with the material web between an engagement position and a release position.

Moreover, the invention relates to a device for depositing a flexible material web, particularly for the execution of the method, with a supply means for supplying the material web and with a laying means for the zigzag-shaped deposition of the material web at a depositing location, the laying means comprising at least two moveably supported engagement elements that can be brought into opposite laying directions, and the engagement elements being in contact with the material web during the change in position between an engagement position and a release position.

Flexible material webs are used in many areas of industrial processing. The material webs can exist in the form of a textile fabric, such as a woven or knitted fabric, tampon wadding and nonwoven fabric, in the form of paper, natural, plastic or metal products, flat composite materials or composites thereof. Foamed and/or coated and/or fibrous products are also conceivable as a flexible material web that is further processed at a later time.

Since material webs are generally narrow in order to be wound onto rolls, a zigzag-shaped deposition of the material web is performed in receptacles or at depositing locations, such as platforms or the like, in several layers, it being possible to accommodate substantially more linear meters of material in a material pack with substantially fewer joints (splices between two rolls than is possible with individual rolls.

The method of the zigzag-shaped depositing of material web is known by the term "festooning," and the associated device is known by the term "festooner" and from U.S. Pat. No. 5,087,140. In that document, the material web is deposited by means of a laying means on a platform that moves back and forth in the transverse direction. The laying means is formed by a laying arm that is swiveled back and forth in the longitudinal direction.

A device for folding flexible material webs is known from document DE 10203115 A1 in which the material web is guided between two opposing folding blades. To produce the fold or crease on one side, a folding blade is extended and contacts the material web. The folding blade performs two movements, namely a rotational movement and a translational movement. The first folding blade is rotated upward in the direction of the material web emerging from the supply rollers, contacts it at the nearest surface and takes it downward during the next rotational movement in the direction of the surface of the already deposited material web. Right before the section of material web carried along by the first folding blade reaches the stack, the second folding blade now performs a translational retracting movement, thus enabling the section of material web carried along by the first folding blade to be deposited on the stack. The translational retracting movement takes place on the surface of the last-deposited layer or of the last-deposited section of material web—parallel to the laying direction and over the entire laying length. The section of material web moved along by the first folding blade is now deposited on the stack surface, while the second folding blade is rotated upward and carries along the next section of material web, the crease or fold being performed this time on the other, opposite side. The first folding blade is controlled by a first gear drive which also influences the second folding blade by holding it in the depositing position (position of complete advancement) until the first folding blade has formed the crease. A second gear drive influences the up and down movement. The prior art is viewed as disadvantageous in that the translational retracting movement of the engagement element, which occurs over the entire laying length, can lead to damaging of the surface or to folding on the surface of the uppermost layer deposited at the depositing location. Furthermore, the long contact path is associated with friction and thus with energy loss. In addition, electrostatic effects are possible as a result of attractive forces among different materials. During the first translational retracting movement, the surface der depositing location that is not yet covered by material web can impair the surface quality of the folding blade. What is more, due to the connecting rods and the mass thereof, that method does not enable high operating speeds.

In departing from the prior art according to document DE 10203115 A1, it is the object of the invention to provide a method and a device of the type being discussed in which the quality of the deposited material web remains largely uninfluenced.

The above object is achieved in terms of the method by the features of claim 1. According to those features, a method of the type being discussed is embodied and developed such that each engagement element has a contact section that is brought in the engagement position into a contact position and, in the release position, into an idle position, the direction of motion of the contact section running at an angle to the laying direction.

The above object is achieved in terms of the device by the features of claim 10. According to those features, a device of the type being discussed is embodied and developed such that each engagement element has a contact section that is brought in the engagement position into a contact position and, in the release position, into an idle position, the direction of motion of the contact section being oriented at an angle to the laying direction.

According to the invention, it was first recognized that the quality of the deposited material web remains largely uninfluenced if it is subjected to as little friction as possible and if the contact between the contact section of the engagement element and of the material web is as scant as possible. Moreover, it was recognized that small contact surfaces as well as low friction between engagement element and material web can be achieved if the contact section of the engagement element is moved at an angle to the laying direction in order to reach the contact position in the engagement position and, finally, in order to reach the idle position in the release position.

In this way, it is ensured that, upon engagement/contacting and releasing/idling, work is performed over the width of the material web, which is generally many times smaller than the laying length. The contact surface is thus kept small, and the danger of surface damage or undesired folding on the uppermost deposited layer of the material web is thus eliminated for the most part. It is advantageous that, in the case of the inventive direction of motion, the dimensions of the contact region can be kept very small, unlike the generic prior art, DE 10203115 A1. Basically, the material web rolls slowly off of the contact section as the release position is approached. In any case, as the contact section is moved out, none of the entire length of material web is carried along. The releasing of the contact in order to reach the idle position takes place only in the region of the loop in the release position. Preferably, the angle at which the engagement/contacting and releasing/idling by the contact section takes place is 90° to the laying direction. The orientation of the direction of motion at a right angle to the laying direction is advantageous with regard to the uniform contact between material web and contact section as well as with regard to the least-possible contact between contact section and edge region of the material web.

According to one basic form of a simple exemplary embodiment of the method according to the invention, the release position could be reached at the ends of the depositing location and the engagement position could be reached in the region of the material web exiting from the supply means. Alternatively, however, the release could also occur before the depositing location is reached. This case arises, for example, if a special hold-down device with rotating arms is used which takes a loop of the material web that is located at the height level of the lowermost reversal region of the material web on the carrier, ultimately guiding it to the depositing location and performing the hold-down function there on the already deposited material web.

This simple exemplary embodiment could be supplemented by a provision that, when an engagement element working in one laying direction reaches the release position, another engagement element working in the other laying direction is brought into the engagement position. This method could be continued by having a change in laying direction occur when an engagement element working in one laying direction has reached the release position and the other engagement element working in the other laying direction begins contacting and entraining the material web in the engagement position.

The prescribed basic form of a simple exemplary embodiment could be modified in more elaborate fashion through a provision that several engagement elements are provided and that, before the release position is reached in one laying direction of one engagement element, at least one other engagement element works in the other laying direction and at least one other engagement element then works in the one laying direction, whereby the material web is guided in a zigzag-shaped manner before the depositing location is reached.

Since several engagement elements engage alternatingly on the material web and entrain it alternatingly in opposite laying directions, high speeds are attained, thus resulting in substantial time-savings. By the time the material web arrives at the depositing location, it already has the zigzag-shaped alignment beforehand by virtue of the several engagement elements. Depending on the controls and as desired, the preparation of the zigzag-shaped alignment can already go so far as to set the future laying length. To enable a fluid, quick execution of the method with respect to the continuously supplied material web, however, it is preferred that the engagement elements initially realize a small fraction of the laying length in the region of the material web exiting from the supply means, which fraction—along with the reduction of the distance to the depositing location—becomes greater and greater until the laying length is reached from the release position on the one hand to the future release position on the other hand.

In order to enable the position of the engagement elements to be changed with respect to the material web, they could be rotated about a rotational axis or run around on a path. In the latter example, engagement elements mounted on carriages could run on fixed rail.

According to one exemplary embodiment in which the engagement elements rotate with the carrier about a rotational axis, the length dimension of the engagement elements could also be changed in order to realize the desired laying length of the depositing location. This gives rise to the adjustability of the above-described fractions of the laying length the greater the distance from the depositing location is. Another advantage that is associated with the length-adjustability of the engagement elements is that, after leaving the release position, the engagement elements can be moved to an energy-saving position, whereby the torque produced during the movement between release position and engagement position—i.e., during "idling"—is minimized.

According to another exemplary embodiment, the engagement elements could run around on a guideway, particularly on a continuous guide rail. In this exemplary embodiment as well, the engagement elements could be adjustable in terms of distance to the depositing location. This distance adjustment could be achieved on the one hand through the position of the engagement elements on the guide rail and, on the other hand, through the engagement elements' own length-adjustability. An extension mechanism could also additionally be arranged on one carriage in order to position the engagement element.

The engagement elements could each have a contact section whose contact position or whose idle position could be reached by moving the contact section of the engagement element. As an alternative to the motor-driven own movement of the contact section, for example, the contact section could also be moved via a carrier on which the engagement element is mounted. The carrier, angled in this way, could be swiveled in the laying direction until the contact section achieves contact—or idle position.

According to another exemplary embodiment, the depositing location, the supply means and the laying means could be adjusted relative to each other in terms of distance. The stack height plays a role here: the higher the stack, the greater the distance. The depositing location could exist in the form of a rigid platform or as a lift table with pallet or receptacle/box. Alternatively or cumulatively, the laying means could also be raised. In addition, the depositing location and/or the laying means and/or the supply means could also change, i.e., travel back and forth. That is expedient in order to fully exploit the space at the depositing location—for example, within a box located there or on the surface of a pallet located there.

The object of the present invention also includes a device that is capable of executing the method steps according to the invention. It was recognized both with respect to the method and with respect to the device that the quality of the material web in the engagement or release position remains largely uninfluenced if the contact section engages in the material web or disengages therefrom in its width dimension and only a small contact surface is implemented.

With regard to optimal force transmission, it is advantageous to arrange a laying means with a rotating carrier at the height level of the supply means in the region of the exiting of the material web. The laying means could also extend beneath the supply means, particularly from the perspective that the engagement elements are positionally movable between an engagement and release position on the one hand as well as between release and engagement position on the other hand. The two positions have height levels that are spaced apart from one another, the release position lying below the engagement position. The supply means could be embodied as a counter-rotating pair of supply rollers between which the material web exits and is free to be contacted and guided and entrained by the engagement elements. If the carrier of the laying means is a fixed device with guideway and carriage circuit, the laying means could extend within the region between supply means and depositing location. This depends on the structural implementation of technical requirements as well as on the available space.

The laying means could comprise two carriers with which at least one engagement element, but preferably several engagement elements is or are associated. The carriers could be spaced apart from one another in the laying direction and/or in the direction of motion of the contact sections of the engagement elements running transversely thereto—i.e., transverse to the material web.

One especially preferred exemplary embodiment makes a provision that the laying means comprises two opposing carriers and that at least one engagement element is associated with each carrier. The engagement elements are each oriented in the direction of the opposing carrier, and the material web is supplied between the carriers. The laying process can be accelerated if a plurality of engagement elements is used. The number of engagement elements per carrier is based on the available space on the depositing location or on the laying length and thus on the need for a more-frequent or less-frequent zigzag bending of the material web and on the desired speed. In any case, with several engagement elements, the zigzag shape of the material web is already prepared before deposition, thus increasing the speed. A correlation exists between the laying length of the material web and the overall height of the device. The shorter the laying length, the greater the overall height of the device.

The spacing of the two opposing carriers could be done in different directions. In one embodiment with rotating carriers, spacing is required in the laying direction and with respect to the direction of motion of the contact sections of the engagement elements—over the width of the material web. The preparation of the material web in opposite directions can be accomplished in this way. The contact sections of the engagement elements of one carrier work from one side, and the contact sections of the engagement elements of the other carrier work from the other side. The spacing—generally perpendicular to the laying direction—of the carriers in the direction of motion of the contact sections of the engagement elements could be adapted to the width of the material web. The spacing both in the laying direction and perpendicular to the laying direction could be adjustable as required. In another embodiment of the device according to the invention, in which the engagement elements run around the carrier, it may be sufficient for the carriers to be spaced apart only in the laying direction. In that case, the contact sections would engage in the material web from only one side. However, it is also true of fixed carriers with circumferential engagement elements that they can be offset in the laying direction and arranged so as to be spaced apart over the width of the material web.

According to one especially preferred exemplary embodiment, the revolving movement of the engagement elements could be implemented through the movement of the engagement elements on the carrier. The engagement elements could run around on a path of motion predetermined by the carrier. For this purpose, the carrier could have a guide rail on which at least one carriage is displaceably arranged. The engagement element could be arranged on the carriage. The guide rail could be a continuous guide rail with at least two curved sections. The shaping of the path of motion and thus the course of the guide rail could be circular or elliptical or even be embodied in the manner of a square, a rectangle, a triangle or any other polygon, but with curved sections instead of corners. In order to ensure continuous running of the carriages, the curved sections of the guide rail could have a radius of greater than 150 mm. Straight sections could have whatever dimensions are required. The carriages run around the prescribed geometry on the basis of the path of motion that is predetermined by the continuous guide rail.

According to one especially preferred exemplary embodiment, the carriage could cooperate magnetically with a motor module of the carrier. In addition to its rollers which cooperate with the guide rail, the carriage could contain magnets that can generate driving forces together with the coils of a motor module. The carriage could absorb the attractive forces of the magnets on both sides and largely compensate for them. In this way, the rollers of the carriage can run in the guide rail at high speeds with little wear. The rollers of the carriage could be equipped with an especially low-wear plastic running surface and be biased. As a result of the biasing of the rollers, backlash is prevented, resulting in low wear. The service life of the rollers depends on the payload. The carriage could comprise a data transmission means for transmitting the carriage position to the motor module. The motor module could be integrated into the carrier on which the guide rail is mounted and contain electromagnetic coils. It could be a modular, fully integrated linear motor with power electronics and path detection in one device.

Alternatively to a magnet-driven carriage, external servomotors could also be provided which produce the movement of the carriage on the rail. The guide rail could be dominant in such a solution, and the carrier could have small dimensions, whereby especially lightweight designs can be implemented. Specifically, one such alternative design of the carrier could be embodied as a non-rotating frame which forms a circumferential path on which the engagement elements are mounted on carriages, thus achieving the desired positions/changes in position.

The circulation of the carriages on the path of motion predetermined by the guide rail could be controlled electronically via a computer, so that the engagement elements come into and out of contact with the material web at the proper position. As regards the magnetically driven carriages, which can be controlled individually and of which a very high number can be used, the possibility arises of completely omitting dancer rollers arranged upstream on the guide means for the provision of material web. In this way, space is saved for the supply and the overall construction is streamlined.

Another possible embodiment could make a provision in which two carriers with guide rails and separately controllable engagement elements are spaced apart only in the laying direction and engage in the material web on only one side and guide it in a zigzag shape (FIG. 10). In that case, the carriers could exist in the form of linear guides with magnetic drive in the form of oblong cuboids/rectangles with rounded front sides or as ellipses and be embodied either as panels or as bodies having a larger depth dimension. The carriers could enclose an angle between them that is open downwardly, with the spacing of the lower front sides of the two carriers defining the laying length of the material web. The upper front sides could be very tightly adjacent to one another.

Another exemplary embodiment involving implementation of the revolving movement of the engagement elements is aimed at moving the carrier itself, whereby the engagement elements change their position together with the carrier. Here, the rotation of the carrier about a rotational axis could play a predominant role. The carriers could be rotatable in opposite directions about the axis of rotation and each be arranged on a shaft. The rotation in opposite directions could conform to the opposing laying directions, and the respective shaft could be motor-driven. However, straight, curved and ellipsoid paths of motion of the carrier are also possible as alternatives. The exemplary embodiment aiming at the movement of the engagement elements exclusively with the carrier represents a very simple variant of the device according to the invention.

One modification of this variant makes a provision that the engagement element is driven separately and arranged for this purpose on its own motor-driven shaft that is associated with the carrier. The speed of the movement of the engagement element can thus be adjusted individually. However, the separate driving of the engagement elements or the individual controlling thereof could also play a role in all other embodiments. Depending on the nature of the surface of the material web, the contact region of the engagement element could be contacted more or less quickly with the web or be detached therefrom.

One variant of the aforementioned exemplary embodiment which is preferred in terms of time-savings makes a provision of arranging several engagement elements on the respective carrier. Three engagement elements per carrier have proven advantageous here in order to form the zigzag laying shape of the material web from emergence from the guide rollers to the depositing location. The engagement elements could either rotate exclusively with the carrier or—preferably—additionally be driven separately and thus also be controllable. The carrier could be embodied as a plate. To save materials, the carrier could have a polygonal silhouette.

An especially high level of flexibility and precision of the device according to the invention could be achieved by making a provision that the engagement element can be adjusted not only for positioning per rotation or revolution on the guide rail but also with respect to its position within the space between laying means/carrier on the one hand and depositing location on the other hand. For this purpose, the engagement element could be attached to a variable-length support arm. This support arm could support the engagement element on one end and be attached at the other end to the carrier or even to one of the carriages traveling around on the guideway. A linear guide could be provided on the support arm on which a sleeve glides which supports the engagement element with the contact section on its free end facing away from the support arm. The length-adjustment of the support arm could be achieved in a self-rotating carrier by means of toothed racks that cooperate with a toothed wheel that is seated on the shaft that rotates the carrier. With the aid of the variable length, any desired deposition of the material web can be accomplished. For example, depositions in a pyramid shape or other configuration are possible per customer's requirements and storage possibilities. Moreover, by virtue of the precise deposition, it is possible to use the smallest possible amount of space on the pallet or in the receptacle of the depositing location.

In order for the contact section of the engagement element to go into the contact position and into the idle position, it must move. This can be achieved, for example, through the movement of the contact section itself through telescopic lengthening of the contact section or by moving the contact section into the idle or operating position by motor-driven displacement or rotation. A translational movement of the contact section is preferred which could have a cylindrical shape and whose surface has an extremely low level of roughness. The movement of the contact section independently of whether the carrier itself rotates or not can be achieved as described previously. As an alternative to an electric drive, the movement of the contact section of the engagement element could also be achieved pneumatically.

Alternatively or in addition, however, the contact section could also be brought into the contact position and idle position through pivoting of a carrier that does not itself rotate. The pivoting/rotation of the carrier could occur about a rotational axis that extends perpendicular to the laying direction, ultimately resulting in a movement of the contact section that extends perpendicular to the laying direction. In this embodiment, the two carriers can each exist, for example, in the form of a self-contained guide rail with curved and straight sections. Carriages could move on the guide rails with engagement elements. If the contact sections of the engagement elements are to be moved, the respective continuous guide rail can be moved in the manner of a wing. It is irrelevant here whether the carriage is driven magnetically or by electric motor and how compact the carrier and guide rail are. A servomotor could be provided to generate the movement of the carrier. Structurally speaking, the carrier could be moveably supported by means of a chock and a shaft on a base frame such that, in the release position, the engagement element is swiveled out of the region of the material web and, in the contact position, is swiveled into the region of the material web. If several engagement elements are provided on the carrier which are in contact with the material web from the beginning of the emergence of the material web from the supply means, a partial swiveling of the carrier with respect to the engagement element of interest could be performed in the first contact position and in the release position. Alternatively, the movable engagement elements can compensate for the movement of the carrier, so that other contacts to the material web that are spaced closer to the supply means remain unimpaired. According to one preferred embodiment, the device could be equipped both with engagement elements whose contact regions are displaceable and with swivelable carriers (that do not themselves rotate). The swiveling of the carrier can be referred to as a butterfly effect and is advantageous particularly if the lift table is moved in a changing manner—back and forth—and a hold-down device is to remain on the uppermost layer. A sliding movement of the carrier would also be possible.

The at least one engagement element could contact the underside of the material web between engagement position and release position, whereas the at least one other engagement element working in the opposite direction could contact the upper side of the material web between engagement position and release position. Unlike the generic prior art, and in anticipation of rotating carriers with at least three engagement elements, it was inventively recognized that the engagement element closest to the upper side of the material web could contact the underside of the material web and the engagement element closest to the underside of the material web could contact the upper side of the material web. This especially preferred contacting of the material web results in the occurrence of a pulling movement. The laying means could be embodied such that the engagement elements, which are actually adjacent to the upper side or to the underside of the material web, must project behind or in front of the material web in order to reach the underside or the upper side and, there, the engagement position. The abovementioned polygonal shape of a carrier proves advantageous here, since this shaping of the carrier enables a quite small spacing from the supply means, and the forces acting on the contact section do not become too great. In other words: The engagement elements working in opposite directions, which arrive in the engagement position in a time-staggered manner for the purpose of the zigzag-shaped deposition, must therefore arranged spatially in front of or behind the supply means in order to reach the engagement position. The contact position of the contact section enables the entrainment/guiding of the material web. Moreover, the idle position of the contact section enables the final independent zigzag depositing of the material web.

Precisely when the engagement element approaches the release position and the idle position is to be reached, it is important that, when the contact section moves out of the region of the material web, the material web is not carried along and does not slip.

For this reason, a hold-down device could be provided on the engagement element according to one exemplary embodiment. A provision could be made that the hold-down device can be bought into the operating position by no later than the moment at which the material web is deposited on the uppermost layer of the material web already deposited at the depositing location or at the depositing location itself as the first layer. The hold-down device could be flat and reach the upper or underside of the material web, respectively, through rotation or displacement. Alternatively, the embodiment of a pneumatically operating plunger is possible. Such a hold-down device with plunger could have a sleeve from which the plunger can be extended. The angle of the overall plunger could also adjusted and/or the plunger could be moved forward and backward.

The problem of the hold-down device provides an opportunity to explain the swivability of a carrier—with several carriages that does not itself rotate—with engagement elements to produce the butterfly effect: The butterfly effect could have two basic functions. As already explained above, one function could be aimed at achieving release and contact via the engagement elements coming into or out of contact with the material web at the relevant positions. The carrier is moved with its lower region away from the material web and with its upper region at the level of the supply rollers toward the material web.

A second function of the butterfly effect could play a role in connection with the retention of a hold-down device on the surface of the uppermost deposited material web in the case of a changing depositing location/a lift table that runs back and forth or even a laying means that runs back and forth. While the contact region of the engagement element comes out of contact with the material web in the release position, the hold-down device should remain as long as possible on the surface of the uppermost deposited material web. For this purpose, the carrier could be moved below in the region of the crease formation at the depositing location in the direction of the material web, follow behind the receding depositing location for a certain amount of time, as it were, while the contact region of the engagement element is moved away from the material web. A consequence of this movement in the lower region is that the carrier is moved away from the material web in the upper region. Here, it must be ensured that the contact region of the engagement element remains in contact with the material web. This could be achieved by an overall longer design of the contact region and/or by a commensurate compensating advancement of the contact region.

As an alternative to the butterfly effect that refers to the entire carrier, the butterfly effect could also refer to the hold-down device itself. So while the carrier is not swiveled, structural measures are taken for the movement of the hold-down device. This offers the advantage that no large masses have to be moved. In any case, the hold-down device should remain as long as possible on the uppermost layer of the deposited material web even in case of changing movement of the depositing location or of the laying means and only be removed when the next carriage approaches the release position at the end of the laying length with the next engagement element in contact with the material web.

At this juncture, the difference between a "crease" of the material web and a "loop" of the material web merits explanation. In principle, the "loop" refers to the region of the reversal from the "zig" to the "zag" in the material web to be deposited in a zigzag shape, independently of whether it is in contact with the engagement element or not. In relation to the depositing location, one speaks of the "deposited" loop, which has been deposited but not yet pressed flat, that is, has not yet been creased. The "crease" is created after a hold-down device has exerted pressure on the deposited loop. The background for the formation of creases is the desire for horizontal layers of the deposited material web. If the loops were to remain, the depositing location could not be optimally exploited and the layers would have upwardly arched edges in the region of the loops, so that the deposited product would not have the desired quality. How pronounced the crease is and whether the crease has the shape of an arch or is more like a fold depends on the material characteristics of the material web and on the pressure applied and desired quality.

An alternative embodiment of a hold-down device which can be associated with any kind of the device according to the invention could be equipped in an innovative manner with rotating arms and gripper jaws. The hold-down device could be attached to the carrier and/or to the machine frame. The hold-down device could have two or more arms that rotate independently of each other at each of whose free ends a gripper jaw is arranged. Theoretically, an embodiment with only one arm would be possible. The gripper jaw could have an upper part and a lower part which correspond in the manner of pliers and permit the engagement element to exit laterally. The upper part and the lower part of the gripper jaw could advantageously be controllable and variable in terms of pressure load and the degree of opening and closing depending on the nature of the material web.

In light of the fact that the engagement elements are also controlled separately, the independent movement of the arms is advantageous in that the hold-down device can always be adapted to the current speed and positional situation of the material web supply. In addition, the different functions of the hold-down device can be executed at different speeds. The independent movement of the arms could be achieved using different motors and suitable force transmission means.

Besides the known exertion of pressure on the deposited loop of the material web in order to create the crease, the hold-down process includes, in a novel and inventive manner, a complete sequence of movements.

The lowermost reversal region of the material web on the carrier is predetermined by its construction and is disposed at the shortest distance from the depositing location located beneath the carrier. The lowermost reversal region of the carrier is simultaneously the place at which the engagement element reaches the release position and, after idling, engages anew in the material web. The arms of the hold-down device could have suitable dimensions in order to carry out the different functions, and the depositing location could be displaceable.

In a hold-down device with two arms, the sequence of movements is as follows: As soon as the engagement element approaches the lowermost reversal region with the loop of the material web, the gripper jaw of the first arm of the hold-down device opened for this purposes engages around the incoming material web together with the engagement element. After that, the upper and lower parts of the gripper jaw of the first arm close. The upper part contacts the upwardly pointed upper side of the material web, and the lower part contacts the deflected, downwardly pointing upper side of the material web. Through the pliers-like design of the laterally open gripper jaw, the engagement element and its contact region can be moved out of the loop transverse to the laying direction. The removal of the engagement element takes place during the rotation. The first arm rotates with the encompassed loop to the depositing location. Meanwhile, the second arm is still located in the region of the depositing location, the lower part of the gripper jaw resting on the previously deposited material web and the deposited loop being acted upon by pressure and forming a crease. The gripper jaw of the second arm simultaneously still holds the loop taken up from the device between the closed upper and lower part. Continuing the sequence of movements of the innovative hold-down device, the second arm, which is still located in the region of the depositing location, is pulled with closed gripper jaw from the loop to be deposited and, as the gripper jaw opens upwardly, rotates to the lowermost reversal region of the material web on the carrier. A smoothing of the loop already occurs during pulling of the gripper jaw from the material web guided to the depositing location. While the second arm now rotates upwardly to the lowermost reversal region of the carrier in order to engage again around the loop along with engagement element with opened gripper jaw, the first arm is rotated downwardly with closed gripper jaw to the depositing location. The rotation described here is repeated at high speed.

In the context of the novel hold-down device described here, "closed" means that the upper and lower parts of the gripper jaw have small spacing according to the desired controllable retention quality on the encompassed loop of the material web. On the one hand, the continuous conveyance of the material web to the depositing location is supposed not to be impeded, but on the other hand, guidance is to be provided and, finally, the material web surface is to be handled with care.

The contact surfaces of the upper and lower part of the gripper jaw could be specially coated in order not to cause any damage to the material web. The shape also plays a role. The upper part could be bent upward at the free end so that, in order to protect the material web surface, no contact occurs between the material web and the upper part edge. Regarding the lower part, it is necessary for at least one section that contacts the depositing location and forms the crease to have a plate-like design.

The innovative hold-down device described above could be used in a device according to the invention which comprises two carriers with the outer silhouette of extended cuboids that are arranged opposite one another and are spaced apart from each other both in the laying direction and in the direction of the width of the material web. When viewed from the front, this device would look like a downwardly opening angle, the opposing angle legs being spaced apart according to the width of the material web and the lower angle ends according to the laying length. The fixed carriers could comprise guideways on which electrically or magnetically driven carriages with engagement elements run around. The engagement elements of one carrier could point to the engagement elements of the other carrier. Both carriers could be attached in a machine frame at a substantial distance from the ground on which the depositing location is positioned. Such devices are capable of attaining very high laying speeds, to which the innovative hold-down device is also adapted. The innovative hold-down device could be arranged on the lower end of each carrier.

The present invention is aimed particularly at flexible material webs whose width is less than 120 mm, preferably 20 mm to 120 mm. It could be a dressing material or edging material for clothes. However, it is possible to apply the invention over larger widths of the material web. For example, if the width of the material web is between 120 mm-400 mm, the contact sections of the engagement elements could be enlarged. The use of two devices is also conceivable, however. The two devices would then be synchronized. Specifically, a device consisting of two carriers spaced apart only in the longitudinal direction (FIG. 10) could be duplicated in a mirror-inverted manner and the two devices placed opposite one another at a distance corresponding to the material width. In this way, engagement elements could be moved into the material web region from both sides and establish contact. The previously described innovative hold-down device could also be provided in this mirror-inverted embodiment of the device according to the invention. Only one innovative hold-down device with broadened gripper jaws would be required for each pair of carriers working in the same laying direction. Control and synchronization play a large role in the invention, especially in devices for wider material webs.

Various possibilities exist for advantageously embodying and developing the teaching of the present invention. Reference is made in this regard to the claims subordinate to claim 1 on the one hand and to the following explanation of several exemplary embodiments of the invention based on the drawing on the other hand. In the context of the explanation of the cited exemplary embodiments of the invention, preferred embodiments and developments of the teaching are also explained in general.

The figures show method and device features of the invention, which relates to the zigzag-shaped deposition of a flexible material web 1 at a depositing location 2.

The material web 1, which has a width of less than 120 mm here, exits from a pair of supply rollers 3, 4, which are a component of a supply means. The supply rollers 3, 4 rotate in opposite directions, which is illustrated by arrows having no further designation.

At least two of several engagement elements 5, 6 of a laying means that can be moved in opposite laying directions A, B contact the material web 1 and guide it to the depositing location 2. In doing so, the engagement elements 5, 6 change their position during the contact with the material web 1 between an engagement position E and a release position F.

Figure 1:
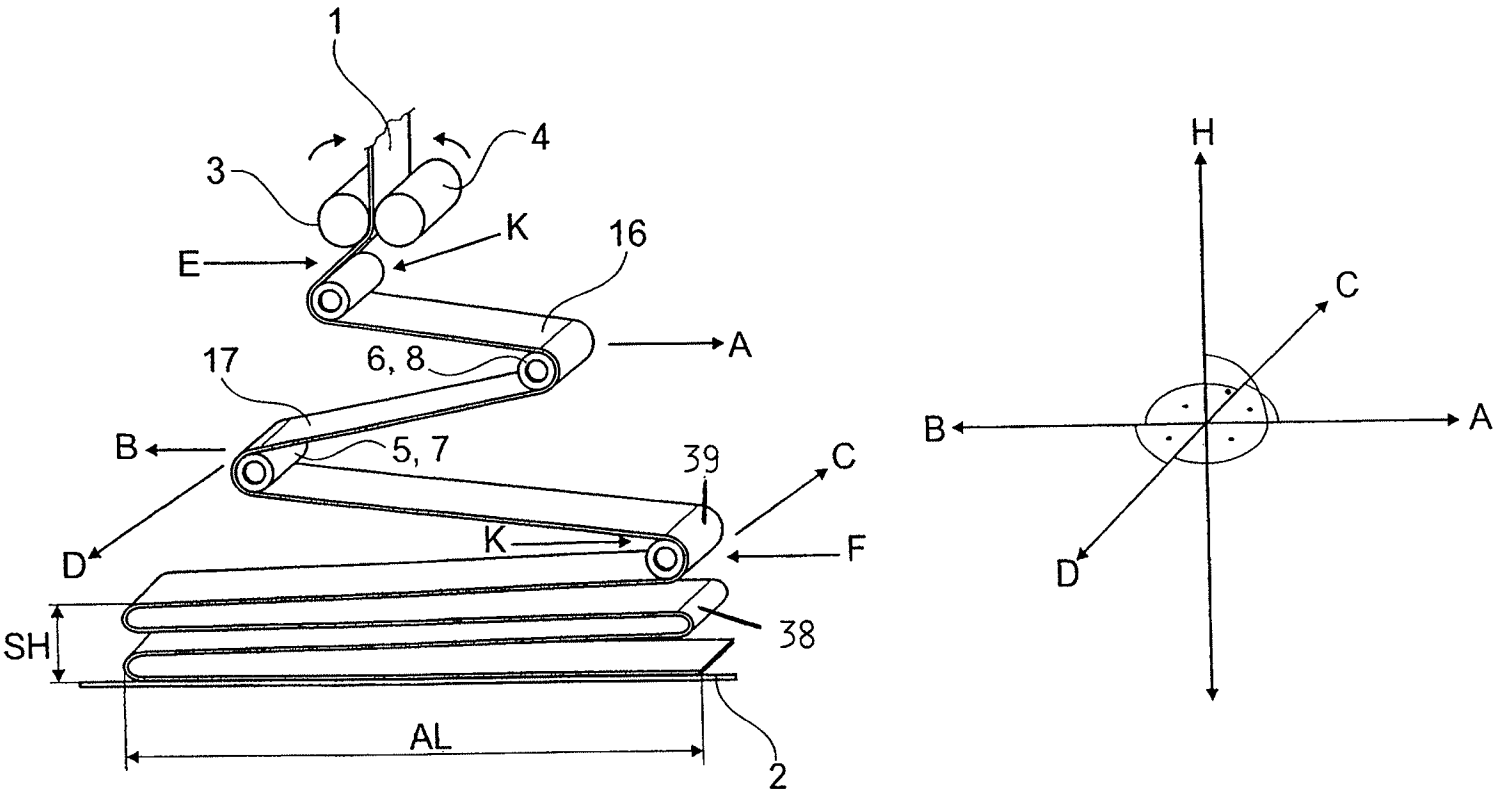
FIG. 1 shows, in schematic, perspective representation, a sketch to explain the method according to the invention.

According to the invention, each engagement element 5, 6 has a contact section 7, 8 that is brought into a contact position K in engagement position E and into an idle position L in release position F—see FIGS. 2, 5, 6, 8. The direction of motion C, D of the contact sections 7, 8 runs orthogonal to the laying direction A, B. Together with the height H, a three-dimensional Cartesian coordinate system is produced which is shown in FIG. 1 next to the schematic diagram.

The engagement position E is located in the region of the exiting of the material web 1 from the supply rollers 3, 4, somewhat below same. In the engagement position E, contact is established between the contact sections 7, 8 of the engagement elements 5, 6 and the material web 1 as the contact section 7 or 8 is moved in the direction of motion C or D, finally reaching the contact position K and contacting the material web 1.

Figure 5:
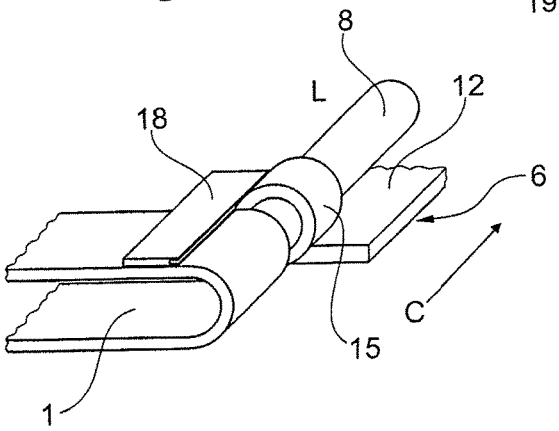
FIG. 5 shows the subject matter from FIG. 4 in the release position after the idle position has been reached, still with hold-down device.
Figure 6:
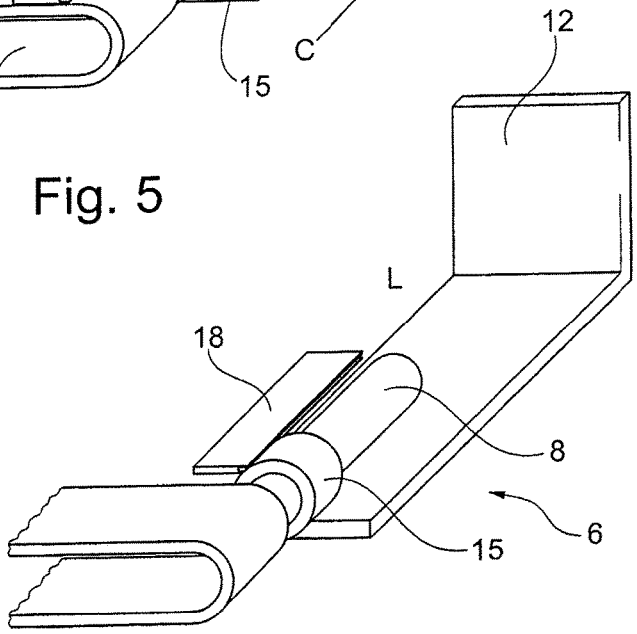
FIG. 6 shows the subject matter from FIG. 5 in the release position after the idle position has been reached, with retracted hold-down device.

In the first, second and third exemplary embodiments, the release position F is located at the opposing ends of the depositing location 2. The ends of the depositing location 2 are approached alternatingly and continuously by the engagement elements 5, 6 together with the material web 1 according to the laying directions A, B. Before a crease 38 of the deposited material web 1 is formed, the deflection regions of the material web 1 are referred to as loops 39. The removal of the contact section 8 from the deposited loop 39 of the material web 1 is shown in FIGS. 5 and 6, in which the contact section 8 has already reached the idle position L.

The engagement elements 5, 6 are controlled such that, upon reaching the release position F through an engagement element 6 working in the laying direction A, another engagement element 5 working in the other laying direction B is brought into the engagement position E.

Figure 2:
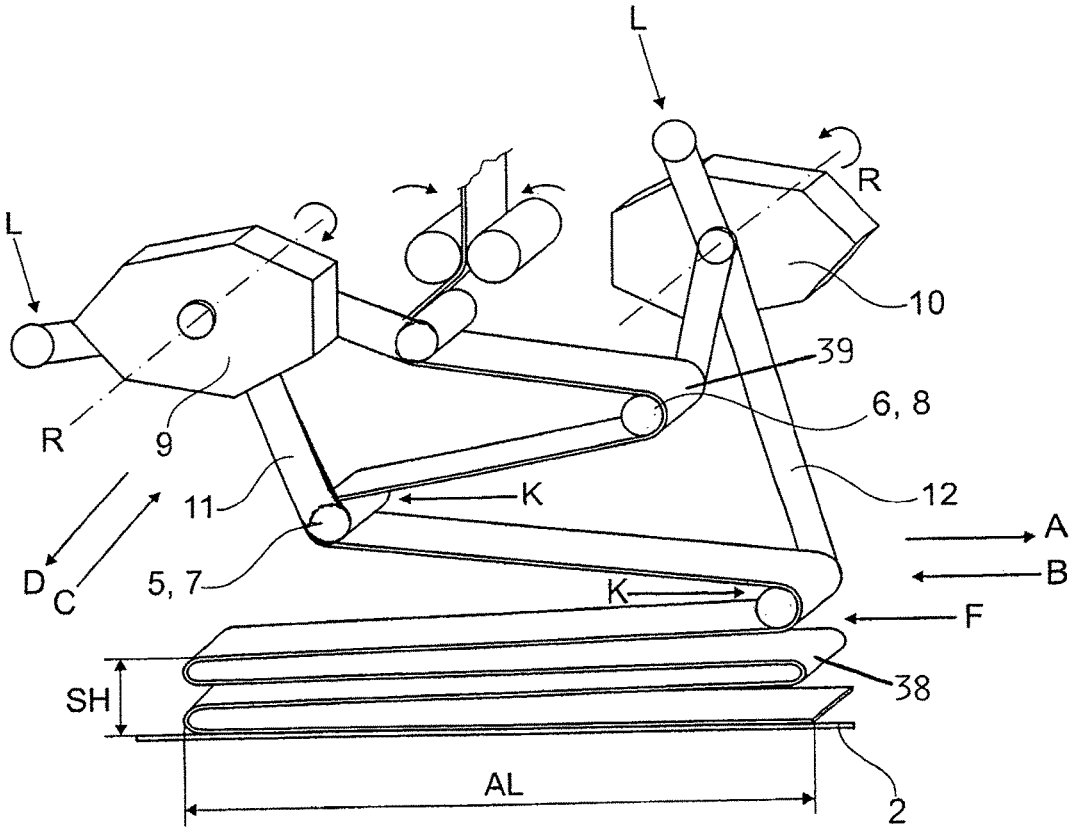
FIG. 2 shows, in schematic, sketch-like, perspective representation, the subject matter from FIG. 1, supplemented with components of the inventive device according to a first exemplary embodiment.

In the present first exemplary embodiment, three engagement elements 5 and 6 are respectively provided, as shown in FIG. 2. While one of the three engagement elements 5 or 6 is located in the release position F or engagement position E and one other one is in the contact position K between the engagement and release position E, F, the third engagement element 5 or 6 is located in the idle position L.

Here, FIGS. 1 and 2 show that, upon reaching the release position F in the laying direction A of the engagement element 6, three other engagement elements 5, 6 are already in the contact position K.

First, an engagement element 5 working in the laying direction B had reached the engagement position E, where it reached the contact position K; this was followed by another engagement element 6 working in the laying direction A, and—precisely at the moment at which the engagement element 6 there reached the release position F—an engagement element 5 working in the laying direction B again reached the engagement position E, where it reached the contact position K.

In the schematic diagram in FIG. 1, all four engagement elements 5, 6 are at different positions, the engagement elements 5, 6 having appeared first and last approaching the extreme positions—engagement position E, release position F. The two alternatingly working engagement elements 5, 6 are located at different distances from the extreme positions—engagement position E, release position F—whereby the material web 1 is already guided in a zigzag manner before reaching the depositing location 2. In the schematic diagram shown here, the laying length AL only reaches its maximum dimension when two release positions F are successively reached at both ends of the depositing location 2. In other words: The zigzag shape implements only fractions of the laying length AL as the distance to the supply rollers 3, 4 becomes smaller.

In the second exemplary embodiment according to FIG. 2 with two respective active engagement elements 5 or 6 and one respective engagement element 5, 6 in idle between the release and engagement positions F, E, a set of three engagement elements 5 that works in the laying direction B and a set of three engagement elements 6 that works in the laying direction A deposits two layers of the material web 1 at the depositing location 2, i.e., two half laying lengths AL per side, thus saving time.

Figure 3:
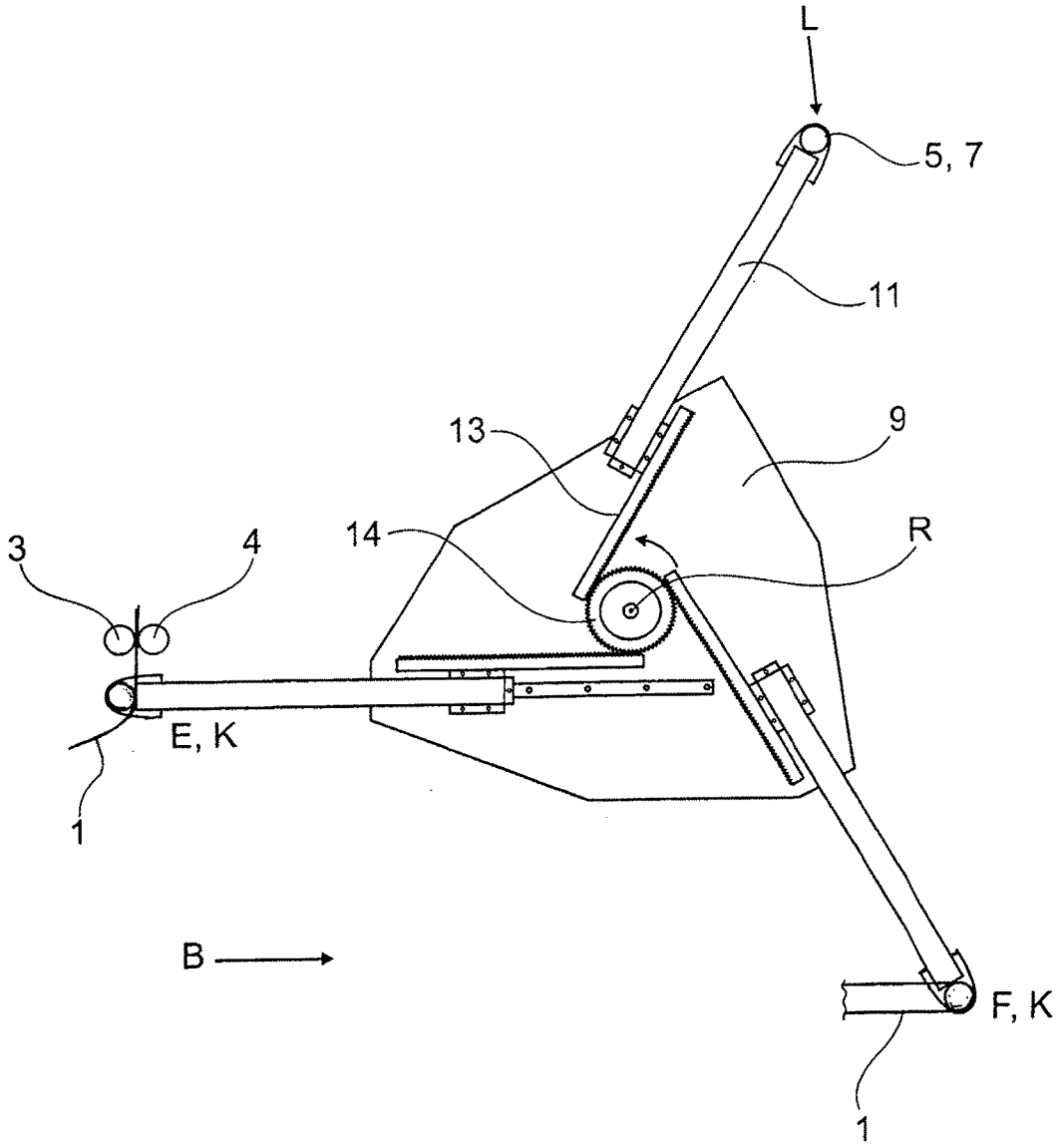
FIG. 3 shows, in a purely schematic representation, detail from FIG. 2 pertaining to one of the two carriers.

FIGS. 2 and 3 show that a set of three engagement elements 5 and a set of three engagement elements 6 each rotate in opposite directions about a rotational axis R of the carrier 9, 10. FIG. 3 shows a rear view of the three engagement elements 5 on the carrier 9 in a viewing direction corresponding to the direction of motion D. FIG. 3 shows that the length dimension of the engagement elements 5 can be changed in order to achieve the desired laying length AL of the depositing location 2 as well as fractions of the laying length AL before the depositing location 2 is reached.

Furthermore, FIG. 2 shows that the engagement element 5, 6 that is located between the release position F and engagement position E is therefore in idle and pulled in toward the axis of rotation R in order to generate as little torque as possible.

Figure 4:
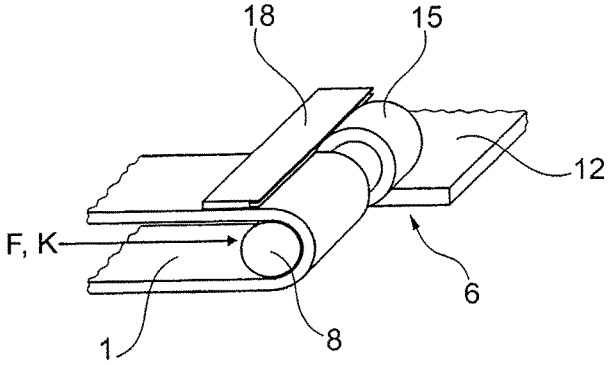
FIG. 4 shows, in schematic representation, detail of the subject matter of FIG. 2 pertaining to the release position of the material web before initialization of the idle position of the contact section with hold-down device.

FIGS. 4 to 6 show that the contact position K or the idle position L of the exemplarily selected contact section 8 of the engagement element 6 is achieved by moving the contact section 8 itself on the engagement element 6. This also applies to the contact section 7.

In the present first exemplary embodiment, the height of the depositing location 2 can be changed and adjusted as a function of the stack height SH with respect to the distance to other components. The carriers 9, 10 and the supply means with the supply rollers 3, 4 can be moved in the directions of motion C, D.

According to the first exemplary embodiment, the laying means comprises two opposing carriers 9, 10 existing in the form of polygonal plates. Three engagement elements 5 are associated with the carrier 9 and three engagement elements 6 are associated with the carrier 10. The two carriers 9, 10 are arranged somewhat below the height level of the supply rollers 3, 4 in the region of the exiting of the material web 1 and can be rotated about the axis of rotation R in opposite directions. The rotation is enabled by a shaft (not further designated) of the respective carrier 9, 10. It should be pointed out here that the shaft is supported in a machine frame that is not shown here. As a matter of principle, the figures portray features of the invention but not all structural details.

In the present exemplary embodiment, the respective three engagement elements 5, 6 rotate exclusively with the respective carrier 9, 10. However, each of the three engagement elements 5, 6 can be adjusted separately in terms of the position of the spacing between carrier 9, 10 and depositing location 2. For this purpose, each engagement element 5, 6 comprises a variable-length support arm 11, 12 which performs the change in position by means of a toothed rack 13 and a toothed ring 14 seated on the central shaft of the carrier 9, 10. Not shown here is an electric motor along with control by means of which the motor-driven positioning of the engagement element 5, 6 is performed via the support arm 11, 12.

FIGS. 4 to 6 involving the moving of the contact section 8 of the engagement element 6 from the contact position K shown in FIG. 4 to the idle position L shown in FIGS. 5, 6 along the direction of motion C. Structurally speaking, the contact section 8 is present as a cylindrical component that can be displaced in a sleeve 15. The sleeve 15 is arranged on the angled end of the support arm 12. An electric motor (not shown here) is provided in order to produce the movement. The contact section 8 is moved translationally from the material web 1 into the sleeve 15 and partially through it. This explanation also extends firstly to the reaching of the contact position K in the event that the contact section 8 of the engagement element 6 is moved in the direction D and, secondly, in analogous fashion—just with a different direction of motion—to the contact section 7 of the engagement elements 5 as well.

The device is constructed such that the contact sections 7 of the engagement elements 5 contact the upper side 16 of the material web 1 between the engagement position E and release position F. In contrast, the contact sections 8 of the engagement elements 6 contact the underside 17 of the material web 1 between the engagement position E and release position F. The choice of the terms "upper side and underside 16, 17" is determined according to which side of the first layer of the deposited material web 1 at the depositing location 2 points upward and has nothing to do with the quality of the material web 1 here. Theoretically, however, the contact sections 7, 8 could also be adjusted materially as a function of the nature of the surface of the upper sides and undersides 16, 17.

The first exemplary embodiment makes a provision that, between the engagement position E and release position F, the engagement element 6 that it closest to the upper side 16 of the material web 1 contacts the underside 17 of the material web 1 and that the engagement element 5 that is closest to the underside 17 of the material web 1 contacts the upper side 16 of the material web 1. A pulling of the material web 1 occurs here. The carrier 9 with the engagement elements 5 is adjacent to the underside 17 of the material web 1. In order to reach the engagement position E and to move the contact section 7 there in the direction D, the corresponding engagement element 5 must be brought in front of the material web 1 in the laying direction A. The carrier 10 with the engagement elements 6 is adjacent to the upper side 16 of the material web 1. In order to reach the engagement position E and to move the contact section 8 there in the direction C, the corresponding engagement element 6 must be moved behind the material web 1 in the laying direction B. The carriers 9, 10 are offset with respect to one another. The carrier 9 is arranged parallel to the direction of motion D in front of the material web 1 and carrier 9 is arranged parallel to the direction of motion C behind the material web 1. The spacing of the carriers 9, 10 in the direction of motion C, D is predetermined by the width dimension of the material web 1.

Figure 7:
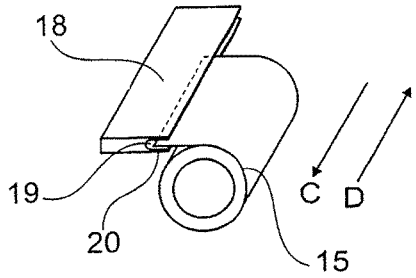
FIG. 7 shows, in schematic representation, detail of the subject matter of FIGS. 4 to 6 pertaining to the hold-down device and a part of the engagement element.

FIGS. 4 to 7 show that a hold-down device 18 is provided on the engagement element 6 that, in this exemplary embodiment, can brought into the operating position upon reaching the release position F at the moment of the depositing of the material web 1. FIG. 7 illustrates with particularly clarity: The hold-down device 18 has a groove 19 that slides on a nose 20 of the sleeve 15 of the engagement element 6. This is a linear guide. FIG. 7 shows the idle position in which the hold-down device 18 is located outside of the release position F. In the operating position according to FIGS. 4 to 6, the hold-down device 18 covers the upper side 16 of the material web 1. In order to reach the idle position and completely eliminate the contact to the material web 1, the contact section 8 is finally pushed through the sleeve 15 in the direction of motion C. Anti-loss and locking means (not shown here in detail) are provided in all displaceable components of the device. The hold-down device 18 is also provided in the engagement elements 5 acts accordingly on the underside 17 of the deposited material web 1.

FIGS. 4 to 6 leave open whether the material web 1 is the first layer at the depositing location 2 or a previously deposited uppermost of an already deposited section of material web. In this exemplary embodiment, the hold-down device 18 is used in each of the two abovementioned cases.

Figure 8:
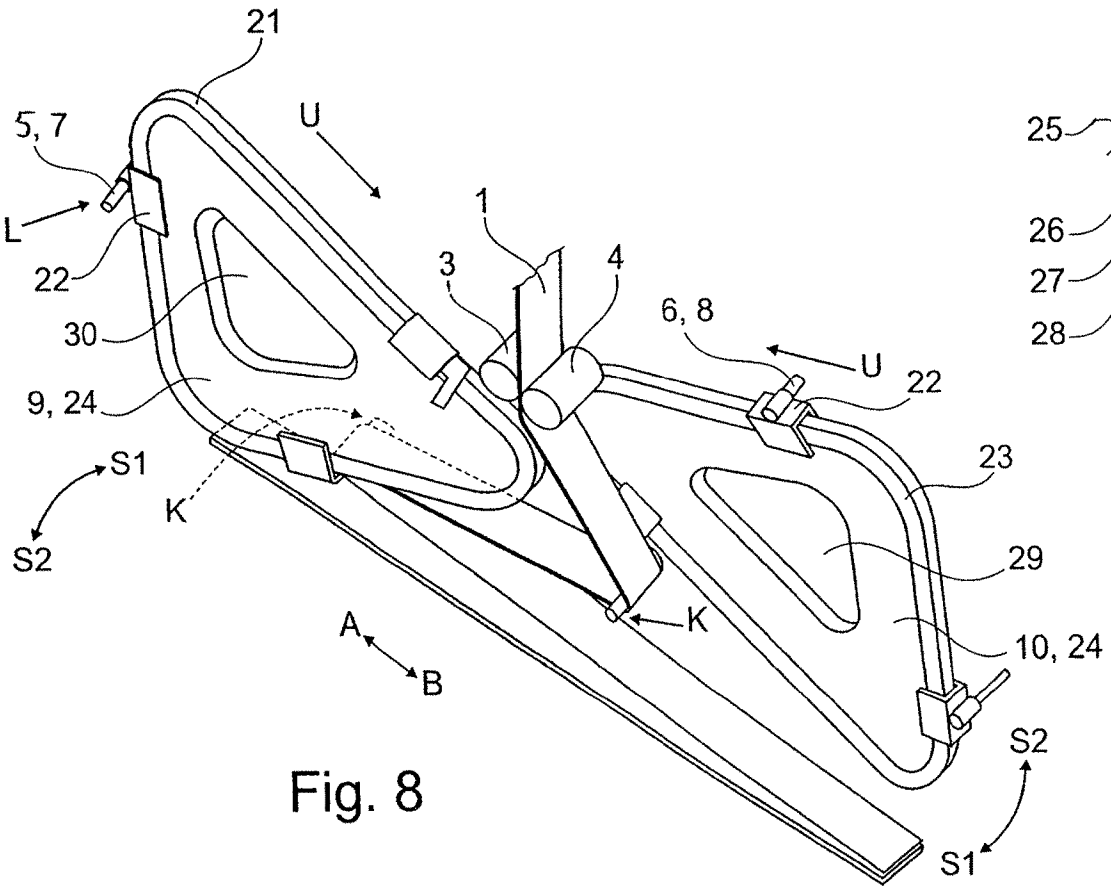
FIG. 8 shows, in schematic, sketch-like, perspective representation, the subject matter from FIG. 1, supplemented with components of the inventive device according to a second exemplary embodiment.

According to the second exemplary embodiment shown in FIG. 8, the laying means comprises two fixed opposing carriers 9, 10 in the form of triangular flat bodies, the corner regions of the triangular shape being rounded off in an arched manner. Three engagement elements 5, 6 that are attached to carriages 22 are associated with each carrier 9, 10. The carriages 22 are each arranged on a guide rail 21 so as to be moveable in the direction of circulation U. The direction of circulation U of the carriages 22 of the carrier 9 is opposite the direction of circulation U of the carriages 22 of the carrier 10. The guide rail 21 is a continuous guide rail—here with three arched sections 23—and is arranged on the outer edge of the carrier 9, 10. It can be seen that one respective engagement element 5, 6 of each carrier 9, 10 is located in the contact position K and in contact with the material web 1. The contact position K in carrier 9 is shown in broken lines. The three engagement elements 5 work in the laying direction A, and the three engagement elements 6 work in the laying direction B. One respective engagement element 5, 6 is located in the middle of the idle position L, one respective engagement element 5, 6 is located right before the time-shifted reaching of the engagement position E (see FIG. 1), and one respective engagement element 5, 6 is located in the contact position K right before the time-shifted reaching of the release position F (see FIG. 1). The engagement element 5, 6 that is closest to the supply roller 3 will then reach the next contact position.

Figure 9:
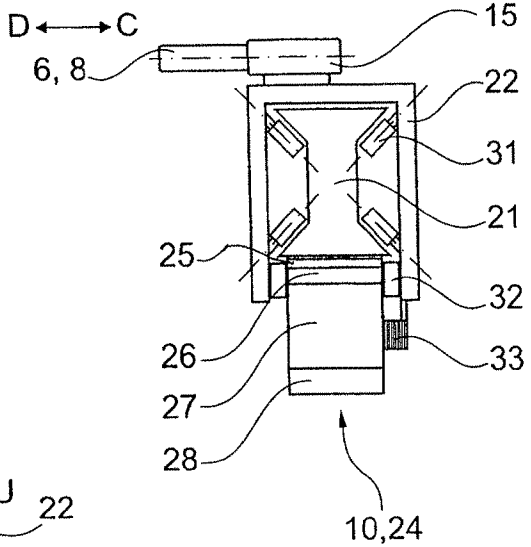
FIG. 9 shows, in schematic, sketch-like representation, a front view of a carriage from FIG. 8 with adjacent carrier/motor module.

The carriages 22 cooperate magnetically with a motor module 24 integrated into the carrier 9, 10. The construction of the motor module 24 follows from FIG. 9. The motor module 24 comprises a mounting area 25 for the guide rail 21, a motor coil region 26 adjacent thereto, a contact region 27 for the power supply and the control signals, and an end region 28. Here, the end region 28 ends at the opening 29, 30 of the carrier 9, 10. The openings 29, 30 only serve the purpose of weight reduction, since the carriers 9, 10 must be supported by means of suitable retaining means (not shown here). As a matter of principle, FIGS. 8, 9 portray features of the invention but not all structural details.

The carriage 22 has four rollers 31 attached to its interior that roll off of the sloping surfaces of a guide rail 21 having a double-T profile. The carriage 22 engages over the guide rail in terms of a U profile. Plate-shaped magnets 32 are arranged on the interior of the free ends of the carriage 22 that cooperate with the motor coil region 26 of the motor module 24. A signal transmitter 33 cooperates with the contact region 27 of the motor module 24. Each carriage can be controlled individually. The sleeve 15, within which the engagement element 6 can be moved back and forth with its contact region 8, is arranged on the base section of the U-shaped carriage 22 connecting the side sections. The hold-down device is omitted in the second exemplary embodiment.

In addition to the moveable contact sections 7, 8 of the engagement elements 5, 6, the carriers 9, 10 can be swiveled according to the second exemplary embodiment. FIG. 8 shows that the carriers 9 and 10 are spaced apart perpendicular to the laying direction A, B and engage in the material web 1 from opposing positions. FIG. 8 is a snapshot of a situation in which no release of the material web 1 is currently occurring through retraction of the contact section 7, 8. The carriers 9, 10 are standing straight, but it is also possible as necessary, in order to create a so-called butterfly effect, for them to be laterally deflected in the swivel direction S1, S2 at the lower end in the region of the release position F (see FIG. 1). The carrier 10 would be swiveled in the direction S2, and the carrier 9 would be swiveled in the direction S1.

Figure 10:
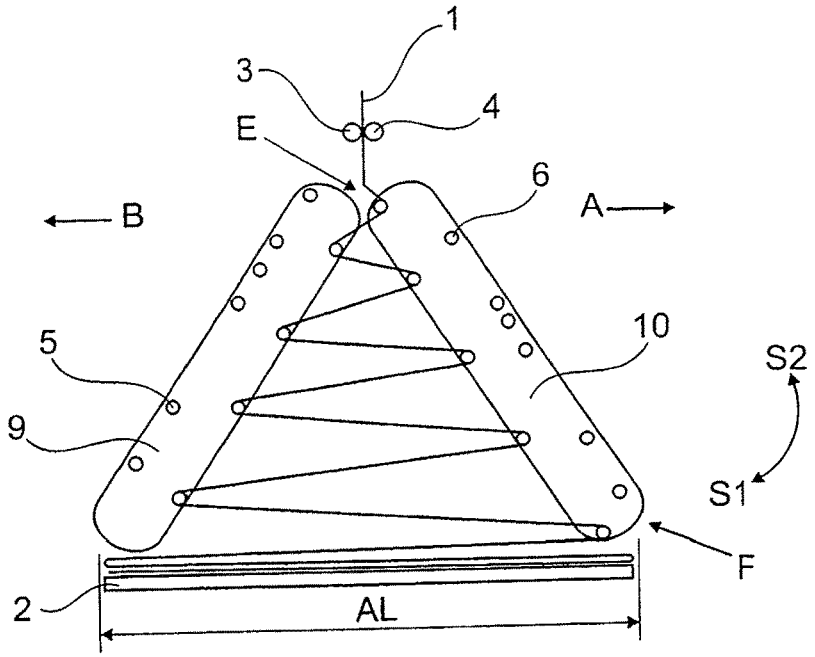
FIG. 10 shows, in schematic, sketch-like representation, the subject matter from FIG. 1, supplemented with components of the inventive device according to a third exemplary embodiment.

The third exemplary embodiment shows a device according to the invention with two carriers 9, 10 that do not themselves rotate and are spaced apart only in the laying direction A, B. The illustration in FIG. 10 is a schematic diagram. The engagement position E can only be reached when the engagement element 5, 6 somewhat closer in the region of the exiting location of the material web 1 from the supply rollers 3, 4. It should clarified here, however, that a plurality of engagement elements 5, 6 with contact sections 7, 8 are provided like in the other exemplary embodiments, but they engage in the material web 1 from the same side and carry it along alternatingly. All of the carriages (which are not shown here in detail) on which the engagement elements 5, 6 are arranged are driven separately and by magnetic means, and the spacing from engagement element 5 to engagement element 6 as well as of the engagement elements 5, 6 among each other can be set as desired. The laying length AL is determined by the spacing of the carriers 9, 10 in the region of the depositing location 2. It can also be seen in the third exemplary embodiment that the laying already occurs above depositing location 2. This preparatory folding immediately after the exiting of the material web 1 from the supply rollers 3, 4 leads to an increase in speed. According to the third exemplary embodiment, the two carriers 9, 10 have nearly the same construction as those according to the second exemplary embodiment, including guide rails 21, carriages 22, and so on. The movability of the contact region 7, 8 of the engagement element 6, 7 from the contact position K into the idle position L must be ensured without damaging the carrier 9, 10. For this purpose, in addition to the movement of the contact region 8, 9 of the engagement element 6, 7, a swiveling movement of the carriers 9, 10 occurs along arrows S1 and S2. To reach the release position F, the carrier 9, 10 is rotated in the lower region in the direction S2, whereas a rotation in the direction S1 occurs in the upper region.

In the event that a very wide material web needed to be laid, a structurally equivalent but mirror-inverted device transverse to the laying direction A, B is associated with and opposite to the device according to the third exemplary embodiment. Precisely opposing engagement elements 5 and 6 would then engage in synchronized fashion at both longitudinal sides in the very wide material web 1 supplied between the devices.

Figure 11:
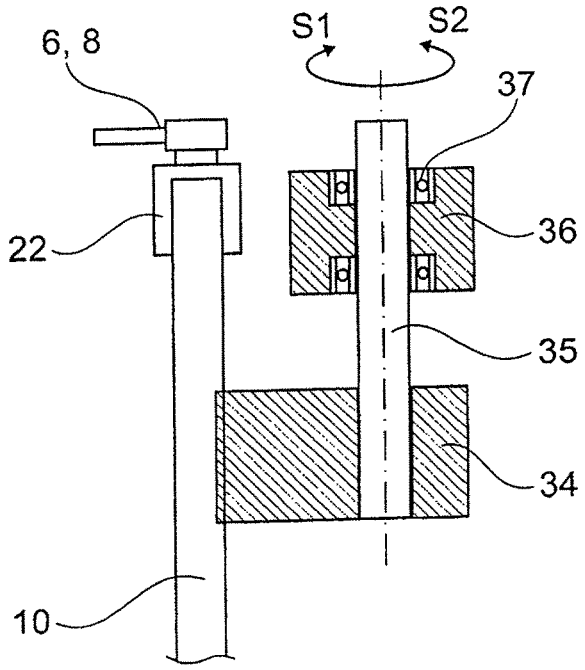
FIG. 11 shows, in schematic, sketch-like, enlarged representation, a side view of a carrier from FIG. 10.

FIG. 11 shows an enlarged and simplified side view of the carrier 10 from FIG. 10, in which only one engagement element 6 is taken into account. In order to achieve the swiveling movement in the direction S1, S2, the carrier 10—and, of course, also the other carrier 9 not shown here—is connected a fastening component 34. The fastening component 34, in turn, is firmly connected to a shaft 35 that is rotatably supported by means of ball bearings 37 in a mount 36. The mount 36 is firmly attached to a base frame (not shown here). The shaft 35 is rotated by means of a servomotor and force transmission means in the form of a gear drive or of a toothed belt (also not shown here). The swiveling movement in the direction S1, S2 occurs in a controlled manner. In the second exemplary embodiment shown in FIG. 8 as well, provisions (not shown there) are made there like in the third exemplary embodiment according to FIG. 11 on the carriers 9, 10 that enable the swiveling movement S1, S2.

Figure 15:
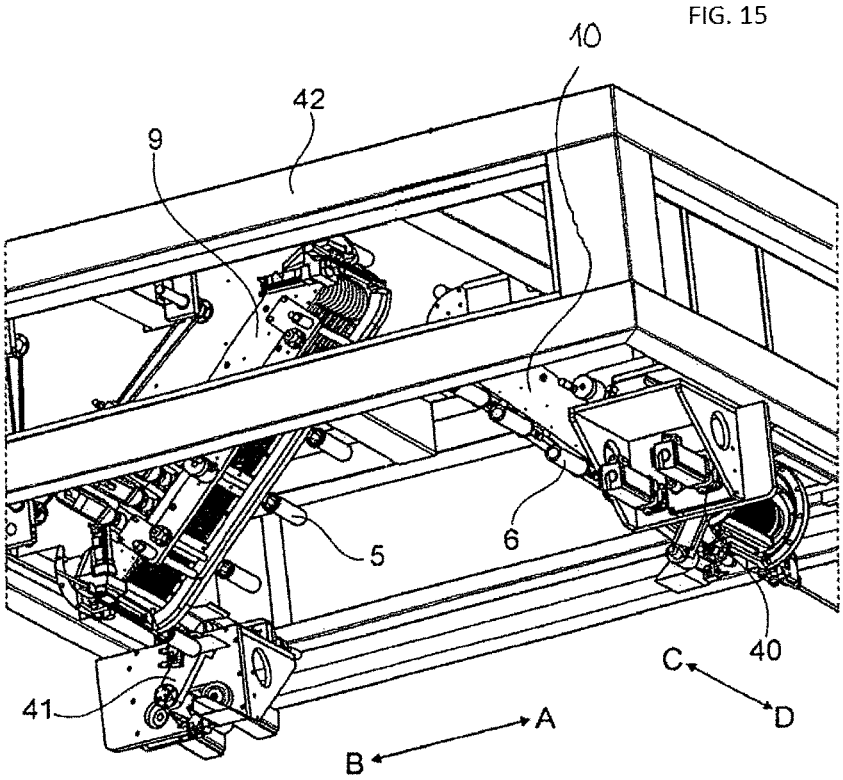
FIG. 15 shows, in perspective representation, the inventive device according to the fourth exemplary embodiment.

A fourth exemplary embodiment, which focusses primarily on the development of the device according to the invention with respect to the hold-down device 40, 41, is shown in FIGS. 12 to 15. FIG. 15 gives an overview of the structure of the device according to the fourth exemplary embodiment, which comprises two fixed carriers 9, 10, each with seven opposing engagement elements 5, 6 pointing toward each other. The carriers 9, 10 are spaced apart from each other both in the laying direction A, B and in the direction of motion C, D as well as in the direction of width of the material web 1. A hold-down device 40, 41 is respectively arranged at the lower end of the carriers 9, 10. The carriers 9, 10 are fixed in a machine frame 42.

Figure 12:
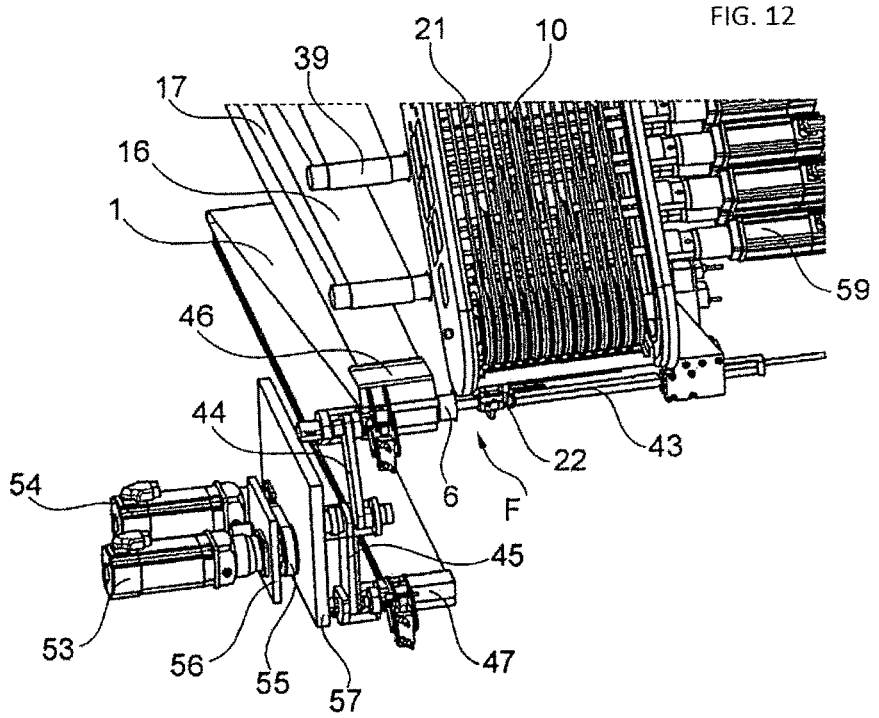
FIG. 12 shows, in perspective representation, the subject matter from FIG. 1, supplemented with components of the partially illustrated inventive device according to a fourth exemplary embodiment.

The fixed carrier 10 of the overall device only shown partially in FIG. 12 comprises guide rails 21 on which electrically driven carriages 22 run around with the engagement elements 6 that contact the underside 17 of the material web 1. The drives for the engagement elements 6 are designated by 59. Reference symbol 43 refers to a push-pull rod by means of which the engagement element 6 is moved in the release position F out of the loop 39 of the material web 1. Unlike the first three exemplary embodiments, the release position F is not located at the end of the depositing location 2, but rather at the level of the lowermost deflection region on the carrier 10.

Figure 13:
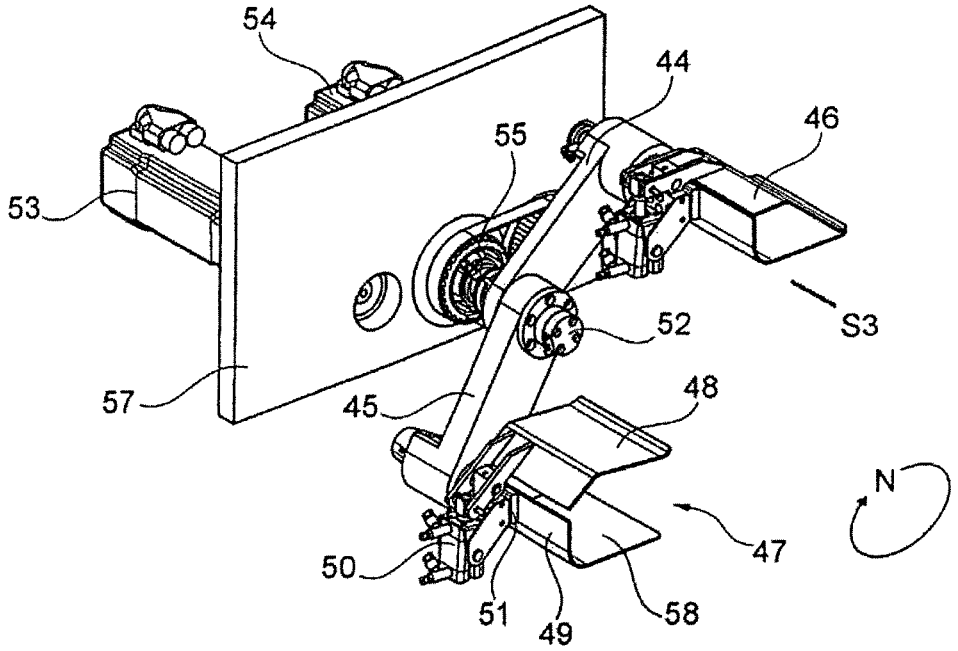
FIG. 13 shows, in perspective, enlarged representation, the hold-down device from FIG. 12 as a single component from another perspective.

FIG. 13 shows the innovative hold-down device 40 as a separate component. The hold-down device 40 has two rotating arms 44, 45 on each of whose free ends a gripper jaw 46, 47 is arranged. The gripper jaw 46, 47 has an upper part 48 and a lower part 49 which correspond in the manner of pliers. To open and close the gripper jaw 46, 47, the upper part 48 is swiveled about a swivel axis S3 of a hinge component 50. The hinge component 50 comprises pneumatic and electronic means (not designated/shown in further detail here) which enables the mechanical opening and closing of the gripper jaw 46, 47 as well as pressure adjustment. The lower part 49 of the gripper jaw 46, 47 is immovably attached to a fastening plate 51 of the hinge component 50. The hinge component 50 is respectively fixed to the arm 44, 45.

The arms 44, 45 are driven separately and rotate independently of one another in the direction of rotation N. The arm 45 is seated on a drive shaft 52. The arm 44 is seated on another drive shaft (not visible here) that is anchored on the drive shaft 52 but separated therefrom by bearings.

The drive of the drive shaft (not shown) and of the drive shaft 47 is embodied by two different motors 53, 54 and two different force transmission means, each designated by 55. The force transmission means 55 comprises individual components that are not further designated, such as toothed wheels, toothed belts, and shafts. A bearing plate 57 and a stabilizing plate 56 are provided.

The motors 53 and 54, the stabilizing plate 56 and force transmission means 55, which is associated with the motor 53, are located on the side of the bearing plate 57 facing away from the carrier 10. The motor 53 is attached to the stabilizing plate 56 and operatively connected via the force transmission means 55 arranged between der stabilizing plate 56 and the bearing plate 57 to the drive shaft 52, which drives the arm 45.

The motor 54 is flanged directly against the bearing plate 57, its drive shaft (not visible here) engages through the bearing plate 57 and is operatively connected to the force transmission means 55, which is located on the side of the bearing plate 57 facing toward the carrier 10. Said force transmission means 55 is operatively connected to the other drive shaft (not shown), which is anchored on the drive shaft 52 and drives the arm 44.

FIGS. 12 and 13 show different snapshots of the procedure carried out with the hold-down device 40 according to the depicted fourth exemplary embodiment. In FIG. 12, the opened gripper jaw 46 is located in the lowermost reversal region of the material web 1 with respect to the carrier 10 and is there in order to engage around the incoming loop 39 of the material web 1 with the engagement element 6. Thereafter, the gripper jaw 46 is closed, which is illustrated in FIG. 13—there without the material web 1—and rotates downward in the direction of rotation N. In parallel, the push-pull rod 43 pulls the engagement element 6 out of the loop 39 encompassed by the laterally open gripper jaw 46. The gripper jaw 46 assumes the function of the engagement element 6 and guides the material web 1 to the depositing location 2, which is located below the carriers 9, 10.

The "closed" gripper jaw 46 is not completely closed; rather, a small gap exists between the upper part 48 and lower part 49 of the gripper jaw 46 in order not to impede the movability of the continuously conveyed material web 1. FIG. 13 shows that the front edge of the upper part 48 of the gripper jaw 46, 47 is bent upward so that the edge does not damage the upper side 16 of the material web 1. Moreover, FIG. 13 shows that the lower part 49 of the gripper jaw 46, 47 has a plate-like section 58.

While the gripper jaw 46 in FIG. 12 is just taking up the loop 39 of the material web 1 with the engagement element 6, the gripper jaw 47 is located in a position right before the material web 1 reaches the complete laying length AL and is still closed.

Figure 14:
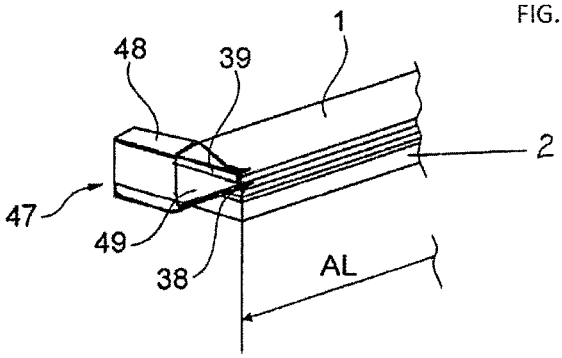
FIG. 14 shows, in perspective, enlarged representation, the gripper jaw of the hold-down device from FIG. 12 as a single component in the region of the depositing location from another perspective.

FIG. 14 shows the underlying upper layer of a section of the material web 1 that has already been deposited. A section of the material web 1 newly brought along by the hold-down device 40 or its gripper jaw 47 is deposited on top of that.

The gripper jaw 47 remains closed until the material web 1 has reached the complete laying length AL. In the meantime, the hold-down process takes place over the plate-like section 58 of the lower part 49 of the gripper jaw 47 on the already deposited material web 1, precisely in the region of the already deposited loop, forming a crease 38.

Subsequently, the gripper jaw 47 undergoes the rotational movement in the direction N and, in doing so, pulls the newly deposited material web 1 smoothly into the desired deposited position. Once the complete laying length AL has been reached, the gripper jaw 47 opens—as shown in FIG. 13—and rotates upwardly according to the direction of rotation N into the lowermost reversal region of the carrier 10 and is prepared for taking up the approaching material web 1 along with engagement element 6 in order to then occupy the space of the gripper jaw 46 shown in FIG. 12. While the open gripper jaw 47 rotates upward, the closed gripper jaw 46 rotates downward and holds the material web 1. The above description of a half-rotation is repeated frequently and at high speeds, so that the hold-down device 40 almost resembles a propeller. The innovative hold-down device 40 according to the fourth exemplary embodiment goes beyond the function of a conventional holding-down.

All of the remarks on the carriers 10 with the hold-down device 40 of the device according to the fourth exemplary embodiment shown in FIGS. 12 to 14 also apply to the second carrier 9 and the second hold-down device 41, with work then being performed in the laying direction B.

In regard to features not shown in the figures, reference is made to the general part of the description.

Finally, it should be pointed out that the inventive teaching is not limited to the exemplary embodiment discussed above. Rather, the widest variety of embodiments of the contact sections, engagement elements, hold-down device and movement sequences, laying patterns and control concepts are possible. What is more, the guide rails with the carriages can be embodied such that they do not engage over the carrier but are only mounted on one side.

The invention claimed is:

1. A method for depositing a flexible material web, comprising:

supplying a material web by means of a supply means and depositing the material web in a zigzag shape by means of a laying means at a depositing location, wherein the material web, after at least two engagement elements that can be moved in at least opposite laying directions have exited from the supply means, the laying means is contacted and guided to the depositing location, the position of the engagement elements changing during the contact with the material web between an engagement position and a release position, wherein each engagement element has a contact section that is brought into a contact position in the engagement position and into an idle position in the release position, the direction of motion of the contact section is oriented orthogonally to the laying direction, wherein the contact position or the idle position of the contact section is reached through the movement of the contact section itself on the engagement element.

2. The method as set forth in claim 1, wherein the engagement position is provided in the region of the material web exiting from the supply means.

3. The method as set forth in claim 1, wherein, when an engagement element working in one laying direction reaches the release position, another engagement element working in the other laying direction is brought into the engagement position.

4. The method as set forth in claim 3, wherein a change in laying direction occurs when an engagement element working in one laying direction has reached the release position and the other engagement element working in the other laying direction begins contacting and entraining the material web in the engagement position.

5. The method as set forth in claim 1, wherein several engagement elements are provided and wherein, before the release position is reached in one laying direction of one engagement element, at least one other engagement element works in the other laying direction and at least one other engagement element then works in the one laying direction, whereby the material web is guided in a zigzag-shaped manner before the depositing location is reached.

6. The method as set forth in claim 5, wherein the engagement elements rotate about a rotational axis and the length dimension of the engagement elements is changed to first realize fractions of the desired laying length and, during depositing, the desired laying length at the depositing location, and in order to produce as little torque as possible during the movement between release position and engagement position.

7. The method as set forth in claim 5, wherein the engagement elements run around on a guideway, and wherein the engagement elements are adjustable in terms of distance to the depositing location.

8. The method as set forth in claim 7, wherein the guideway is a guide rail.

9. The method as set forth in claim 1, wherein the depositing location, the supply means and the laying means can be moved relative to each other.

10. The method as set forth in claim 9, wherein the supply means and the laying means can be moved relative to each other as a function of the stack height.

11. A device for depositing a flexible material web, comprising:

a supply means for supplying the material web, and a laying means for zigzag-shaped deposition of the material web at a depositing location, wherein the laying means comprises at least two moveably supported engagement elements that can be moved at least in opposite laying directions, and wherein the engagement elements are in contact with the material web during the change in position between an engagement position and a release position, wherein each engagement element has a contact section that is brought into a contact position in the engagement position and into an idle position in the release position, the direction of motion of the contact section is oriented orthogonally to the laying direction, wherein the contact position or the idle position of the contact section is reached through the movement of the contact section itself on the engagement element.

12. The device as set forth in claim 11, wherein the laying means with the engagement elements is arranged at least approximately in the region of the exiting of the material web from the supply means.

13. The device as set forth in claim 11, wherein the laying means comprises two carriers spaced apart from each other in the laying direction and/or in the direction of motion of the contact sections, and that at least one engagement element is associated with each carrier.

14. The device as set forth in claim 13, wherein the engagement elements are movable on the carriers in order to undergo a revolving movement.

15. The device as set forth in claim 14, wherein the carrier comprises a guide rail, on which at least one carriage is displaceably arranged, and that the engagement element is arranged on the carriage.

16. The device as set forth in claim 15, wherein the guide rail is continuous.

17. The device as set forth in claim 14, wherein the carriage cooperates magnetically with coils of a motor module of the carrier by means of magnets.

18. The device as set forth in claim 13, wherein the engagement elements can be moved together with the carrier in order to undergo a revolving movement.

19. The device as set forth in claim 11, wherein the engagement element is additionally driven separately in order to adjust the distance to the depositing location.

20. The device as set forth in claim 11, wherein the engagement elements are attached to variable-length support arms.

21. The device as set forth in claim 11, wherein the contact section of the engagement element can be brought into the contact position and into the idle position through the movement of the contact section itself, and that an electric motor is provided to produce the movement of the contact sections.

22. The device as set forth in claim 21, wherein the movement of the contact sections is translational.

23. The device as set forth in claim 11, wherein the contact section of the engagement element can be brought into the contact position and into the idle position through the movement of the carrier, the movement of the carrier being a swiveling movement in a swivel direction.

24. The device as set forth in claim 11, wherein the contact section of the engagement element contacts the underside of the material web between engagement position and release position, and that the contact section of the engagement element working in the opposite direction contacts the upper side of the material web between engagement position and release position.

25. The device as set forth in claim 11, wherein a hold-down device is provided on the engagement element.

26. The device as set forth in claim 11, wherein a hold-down device is provided on the engagement element.

27. The device as set forth in claim 11, wherein a hold-down device with at least two separately driven arms rotating in a common direction of rotation is provided on the carrier on each of the free ends of which arms a gripper jaw is arranged.

28. The device as set forth in claim 27, wherein the gripper jaw of the arm of the hold-down device rotating away from the depositing location is open, and that the gripper jaw of the of the arm rotating toward the depositing location is closed while engaging around a loop of the material web.

29. The device as set forth in claim 28, wherein the gripper jaw, at the moment of the engagement around the loop at the height level of the lowermost reversal region of the material web, is arranged on the carrier, the gripper jaw being laterally open so that the initially also encompassed engagement element can be moved out of the loop in the release position.

30. The device as set forth in claim 27, wherein the gripper jaw has an upper part and a lower part, the lower part having a planar section and applying pressure to the loop of a material web already deposited on the depositing location, thus producing a crease.

31. The device as set forth in claim 11, wherein the width of the material web is between 120 mm-400 mm, and wherein the device is provided with a wide design or a second such device is arranged in a mirror-inverted manner with respect to a device that is spaced apart exclusively in the laying direction, whereby its engagement elements contact the material web in a mirror-inverted, parallel manner.

32. The device as set forth in claim 11, wherein the width of the material web is <120 mm.

* * * * *